United States Patent [19]

Kidd

[11] 4,194,317

[45] Mar. 25, 1980

[54] REMOTELY CONTROLLED AIRCRAFT

[76] Inventor: Al J. Kidd, 5436 W. Washington Blvd., Los Angeles, Calif. 90016

[21] Appl. No.: 892,991

[22] Filed: Apr. 3, 1978

[51] Int. Cl.[2] ..... A63H 27/02

[52] U.S. Cl. ..... 46/76 R; 46/254; 244/93

[58] Field of Search ..... 46/74 R, 76, 79, 254; 244/93

[56] References Cited

U.S. PATENT DOCUMENTS

| | | | |
|---|---|---|---|
| 1,765,195 | 6/1930 | Ax | 244/93 |
| 1,927,835 | 9/1933 | Kellogg | 46/79 |
| 2,858,386 | 10/1958 | Bonner | 46/76 R |
| 3,366,354 | 1/1968 | Sterba | 46/79 |
| 3,920,201 | 11/1975 | Battles | 46/79 |

*Primary Examiner*—Louis G. Mancene

*Assistant Examiner*—Paul J. Hirsch

*Attorney, Agent, or Firm*—Albert M. Herzig; Edward C. Walsh

[57] ABSTRACT

The invention is particularly adapted, but not limited to, control of hand-launched gliders. A weight or mass is suspended in the manner of a pendulum below the aircraft. The weight is controllable by a gimbal mechanism which allows the weight to be swung fore and aft and laterally. The gimbal mechanism includes members mounted to be rotatable about a fore and aft axis and a lateral axis, which axes intersect and are perpendicular to each other. Radio controlled servomotors are provided for individually rotating the gimbal members for controlling the position of the weight or mass for controlling the aircraft in flight. The servomotors are controlled by a radio by way of separate frequency channels.

7 Claims, 4 Drawing Figures

2
2
50
24
66
65
70
26
28
48
64
26
68
78
76
74
56
54
58
30
41
44
40
42
20
12
16
31
32
14
10
60
34

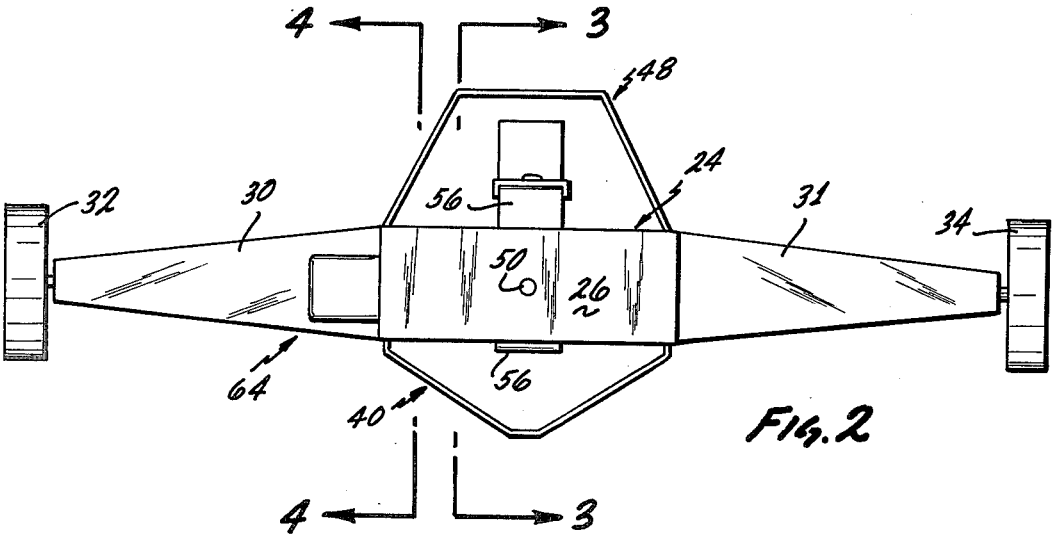
FIG. 2
FIG. 3
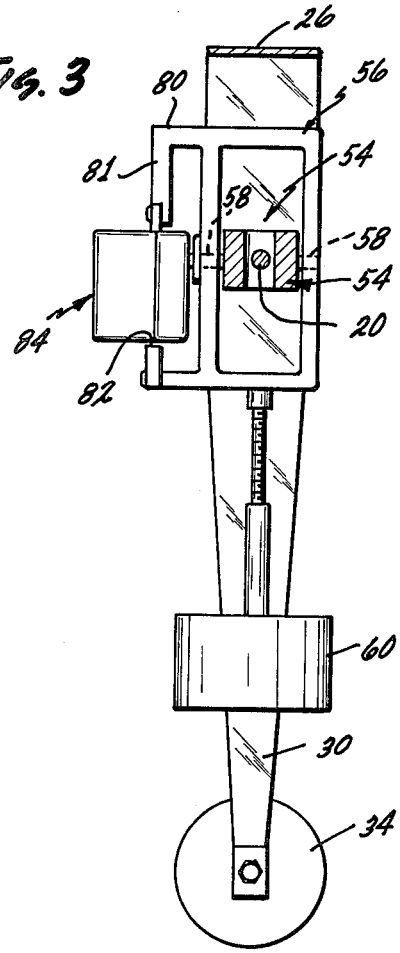
FIG. 4
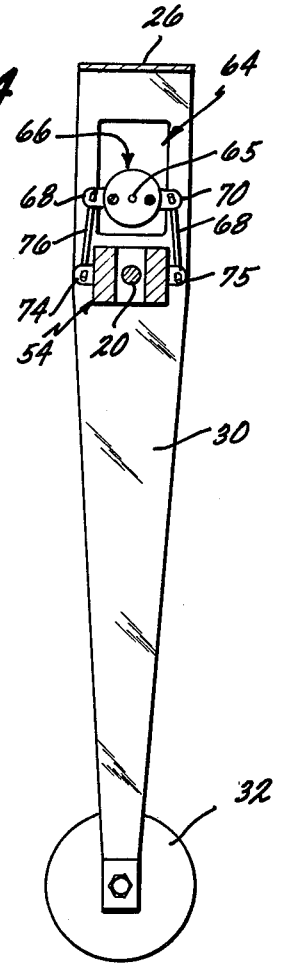

REMOTELY CONTROLLED AIRCRAFT

BACKGROUND OF THE INVENTION

1. Field of the Invention

The field of the invention is that of remote control of aircraft or other flying vehicles and more particularly the control of model aircraft in the form of a hand-launched blider.

2. Description of the Prior Art:

Known prior art is exemplified in the U.S. Pat. Nos. 3,153,877; 3,204,368; 3,920,201 and 3,952,448. The prior art is lacking in teaching of remote control of an aircraft by way of weight or mass suspended in the manner of a pendulum and adjustable by remote radio control for guiding the aircraft.

SUMMARY OF THE INVENTION

In the exemplary form of the invention as described in detail herein it is applied to the guidance of a hand launched glider which is a type of model aircraft. The glider as shown is of a single wing type without fuselage as such.

A frame structure is provided preferably at a position between the wings and over the undercarriage, this structure carrying the remote control mechanism.

The remote control system includes a weight or mass that is suspended below the structure as described above in the manner of a pendulum. The weight or mass may be the battery incorporated in the radio receiver apparatus. The mass is suspended from a gimbal assembly including a first member rotatable about a fore and aft axis and a second member rotatable about a transverse axis, the two axes being mutually perpendicular and intersecting. Electric servomotors under remote radio control are provided to individually rotate the first and second members whereby the suspended mass can be adjusted fore and aft or laterally as necessary to affect desired guidance of the glider. Miniature radio receiving apparatus is provided, with appropriate frequency channels for actuation of the two servomotors, the receiver of course being responsive to a transmitter at a ground station.

In the light of the foregoing the primary object of the invention is to make available an improved manner, means and method of remote control of an aircraft, more particularly but not limited to model aircraft of the glider type.

A further object is to provide means as in the foregoing wherein a weight or mass is suspended in the manner of a pendulum with control means to cause the mass to swing or move either fore and aft or laterally so as to thereby control the position of the aircraft and its path of flight.

A further object is to provide means as in the foregoing including a gimbal assembly and having first and second members individually rotatable about fore and aft and lateral axes which intersect and are mutually perpendicular, the first and second members being adjustable by two radio controlled servomotors or actuators.

Further objects and additional advantages of the invention will become apparent from the following detailed description and annexed drawings.

BRIEF DESCRIPTION OF THE DRAWINGS

FIG. 2 is view taken along plane 2—2 of FIG. 1.

FIG. 3 is a view taken along line 3—3 of FIG. 2.

FIG. 4 is a view taken along line 4—4 of FIG. 2.

Figure 1:
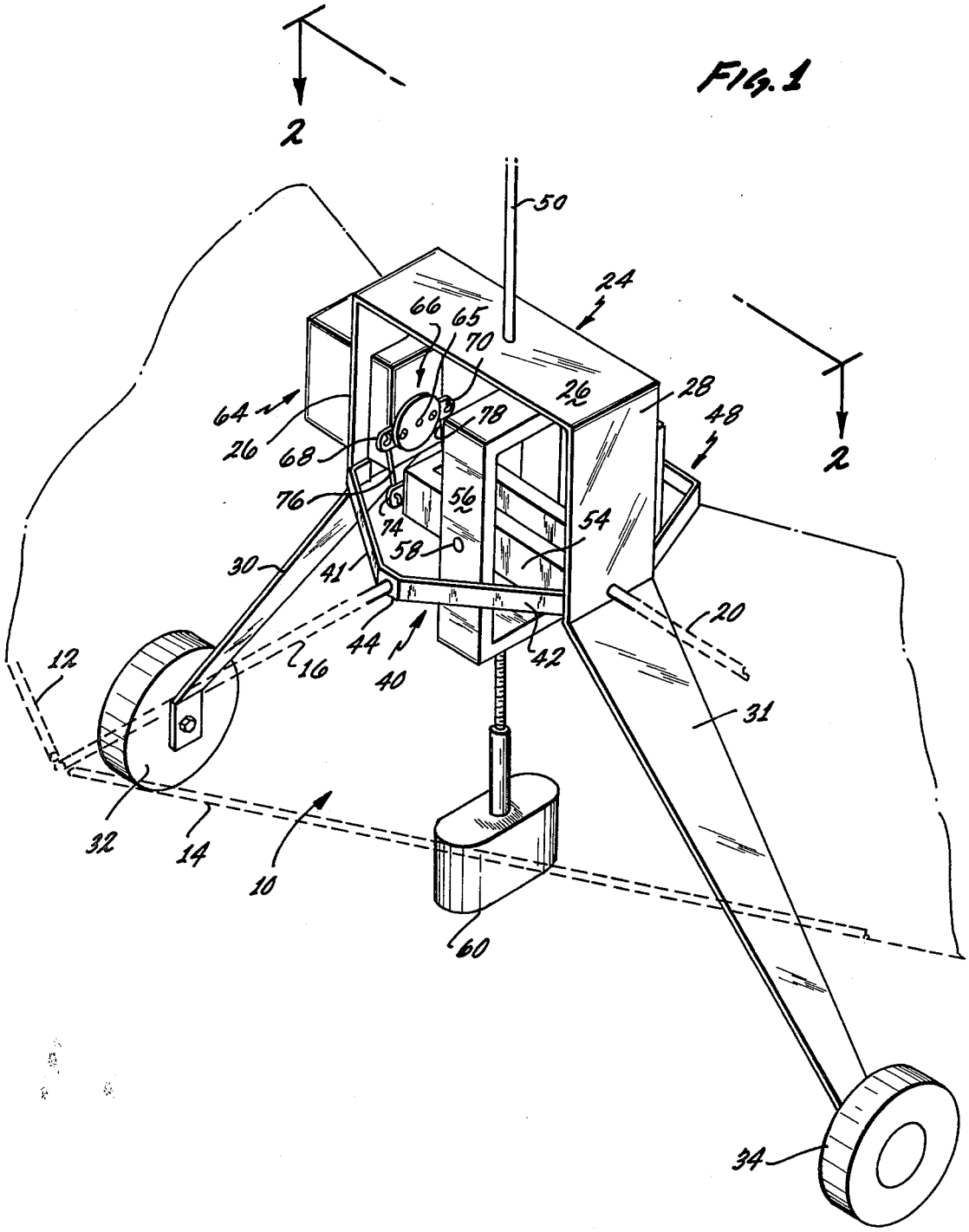
FIG. 1 is an isometric schematic view of a preferred form of the invention.

DESCRIPTION OF THE PREFERRED EMBODIMENT:

Referring now more particularly to the drawings the aircraft is shown in the form of a hand-launched glider which has a wing 10 which may be of a generally conventional shape and construction. The wing includes front or forward frame members 12 and 14 and an intermediate longitudinal member 16. Numeral 20 designates a transverse member.

Situated generally at the juncture of the wings is a frame member or structure 24 having a horizontal upper part 26 and side members or parts 26 and 28. Extending downwardly from the side parts 26 and 28 and diverging outwardly are extensions 30 and 31 which form an undercarriage having wheels 32 and 34 at the ends of these undercarriage members. The wing or wings can be attached to the frame structure 24 in any suitable manner. In the construction as shown there is a front brace member 40 having side parts 41 and 42 which are secured to the lower part of side members 26 and 28 as shown. They may be secured in any suitable manner. The frame 40 has a flat part 44 at its front or apex and the longitudinal frame member 16 is joined to this part. On the other side of the frame structure 24 there is a similar frame 48 which is similarly secured to the side parts 26 and 28 of the frame 24.

A system is provided including a first rectangular frame member 54 which is mounted between the side members or legs 26 and 28 of the frame structure 24, it being mounted to rotate about a transverse or lateral axis which is the axis of the frame member 20 as shown in FIG. 1. As shown the member 54 is in the form of an open rectangular elongated frame. Numeral 56 designates a second gimbal frame member which is also an open rectangular frame as shown through which the first gimbal member 54 extends. The frame member 56 is mounted to swing relatively to a fore and aft axis as identified by the numeral 58 provided by a pivot shaft extending through the first gimbal member 54, the fore and aft and lateral axes intersecting and being mutually perpendicular.

Suspended from the gimbal member 56 is a weight or mass 60 which may in practice be a battery utilized with the circuitry of the miniature radio receiver carried by the aircraft at any convenient position thereon. As may be seen from the foregoing, mass 60 can swing fore and aft by rotation of gimbal member 54 about its transverse axis. Mass 60 can swing laterally by swinging the gimbal frame 56 about fore and aft axis 58.

Numeral 64 designates a miniature electrical servomotor which preferably is mounted as shown in a cutout or opening in the leg 26 of the frame structure 24. It drives the shaft 65 on which is mounted the disc 66 having end extensions 68 and 70. Carried on a part of the transverse shaft 20 is a cross arm 74 and the extensions 68 and 70 of the disc 70 are linked to the ends of the arm 74 by links 76 and 78. As may be seen, when the motor 64 is actuated it drives a gear train which rotates the disc 66, the movement of which serves to drive the gimbal or frame member 54 in one direction or the other about the axis of frame member 20. This causes the weight or mass 60 to swing fore or aft in the manner of a pendulum.

Referring to FIG. 3 of the drawings it will be observed that the frame 56 has rear section as designated at 80 having a frame guard 81 in which is an opening 82 there being servomotor 84 mounted in the opening. This motor is able to drive the shaft 58 for rotating the gimbal frame member 56 so as to swing the mass 60 laterally.

OPERATION

From the foregoing those skilled in the art will readily understand the operation of the invention. As stated the radio receiver can be carried at any convenient position on the glider. The receiver is controlled by a conventional ground transmitter having appropriate frequency channels, one for each of the servomotors 64 and 84. The ground transmitter is of the type provided with a control stick which can be manipulated in the manner of an aircraft control stick. The fore and aft movements of the stick cause the transmitter to transmit signals which are received by the receiver on the aircraft and which cause the motor 64 to swing mass 60 in accordance with movements at the ground. Similarly lateral movements of the stock cause the transmitter to transmit signals to the receiver on the aircraft which in trun provides control signals to the servomotor 84 for actuating the gimbal member 56 for swinging the mass laterally. Thus as can be seen the mass 60 suspended as a pendulum is moved fore and aft along with lateral movements as dictated by the control stick at the ground whereby its mass acting on the aircraft can cause it to assume a desired attitude for climbing, diving, turning, banking, etc. That is the glider can be controlled in the manner of guiding an aircraft.

As can be observed from the foregoing the invention as described herein provides for a means and method of control of a model aircraft such as a glider, for example, which eliminates the need for rudders, ailerons or otherwise and the control instrumentalities normally necessary for manipulation of such control surfaces. The invention for purposes of control is adaptable in powered flight, that is motorized aircraft as well as aircraft such as gliders not having power.

From the foregoing, those skilled in the art will readily understand the nature and construction of the invention and the manner in which it achieves and realizes all of the objects as set forth in the foregoing.

The following disclosure is representative of the preferred form of the invention and is to be interpreted in an illustrative rather than a limiting sense, the invention to be accorded the full scope of the claims appended hereto.

I claim:

1. In a model aircraft, in combination, a wing structure, an adjustable control mass carried by the wing structure, supporting means for the control mass, said supporting means including mechanism whereby the control mass can be shifted laterally or can be shifted fore and aft and means responsive to remote radio signals during flight for causing the control means to be shifted laterally or shifted fore and aft for guiding the aircraft, the aircraft being free of ground connections thereto.

2. Aircraft as in claim 1 wherein the said supporting means for the control mass includes pivotal mounting means whereby the control mass can move about a center either laterally or fore and aft.

3. In a model aircraft, in combination, a wing structure, an adjustable control mass carried by the wing structure, supporting means for the control mass, said supporting means including mechanism whereby the control mass can be shifted laterally or can be shifted fore and aft and means responsive to remote control signals for causing the control mass to be shifted laterally or shifted fore and aft for guiding the aircraft, the said supporting means for the control mass including pivotal mounting means whereby the control mass can move about a center either laterally or fore and aft, the pivotal mounting means for the control mass including a gimbal mounting whereby the control mass is movable angularly about a center either laterally or fore and aft.

4. Aircraft as in claim 3 including a gimbal mounting having the control mass suspended therefrom as a pendulum, the gimbal mounting including a member mounted to pivot about first axis and a second member mounted to pivot about a second axis normal to the first axis said, the said mounting being constructed to permit the control mass to move angularly about the first axis and to move angularly about the second axis.

5. Aircraft as in claim 4 including radio controlled servomotor means for actuating said first member and said second member.

6. Aircraft as in claim 4 wherein one of said axes is aligned with a transverse frame member of the aircraft.

7. Aircraft as in claim 4 wherein one of said members extends through the other member, the other member having pivotal mounting with respect to the said one member.

* * * * *